US007622983B2

(12) United States Patent
Thomas et al.

(10) Patent No.: US 7,622,983 B2
(45) Date of Patent: Nov. 24, 2009

(54) METHOD AND DEVICE FOR ADAPTING THE VOLTAGE OF A MOS TRANSISTOR BULK

(75) Inventors: Olivier Thomas, Herbeys (FR); Marc Belleville, Saint-Egreve (FR); Vincent Liot, Grenoble (FR); Philippe Flatresse, Froges (FR)

(73) Assignees: STMicroelectronics S.A., Montrouge (FR); Commissariat A l'energie Atomique, Paris (FR)

( * ) Notice: Subject to any disclaimer, the term of this patent is extended or adjusted under 35 U.S.C. 154(b) by 0 days.

(21) Appl. No.: 11/687,047

(22) Filed: Mar. 16, 2007

(65) Prior Publication Data

US 2007/0262809 A1 Nov. 15, 2007

(30) Foreign Application Priority Data

Mar. 17, 2006 (FR) ..... 06 50938

(51) Int. Cl.
*H03K 3/01* (2006.01)

(52) U.S. Cl. ..... 327/534; 327/537

(58) Field of Classification Search ..... 327/530–531, 327/534–538
See application file for complete search history.

(56) References Cited

U.S. PATENT DOCUMENTS

| | | | | |
|---|---|---|---|---|
| 4,491,746 | A | 1/1985 | Koike | |
| 5,184,030 | A | 2/1993 | Chung et al. | |
| 5,210,446 | A | 5/1993 | Niuya et al. | |
| 5,686,751 | A * | 11/1997 | Wu | 257/356 |
| 6,175,263 | B1 | 1/2001 | Lee et al. | |
| 6,225,852 | B1 * | 5/2001 | Cleveland et al. | 327/534 |
| 7,113,008 | B2 * | 9/2006 | Perumana et al. | 327/113 |

OTHER PUBLICATIONS

French Search Report from corresponding French Application No. 0650938, filed Mar. 17, 2006.

* cited by examiner

*Primary Examiner*—Dinh T. Le
(74) *Attorney, Agent, or Firm*—Wolf, Greenfield & Sacks, P.C.; James H. Morris

(57) ABSTRACT

A circuit for biasing the bulk of a MOS transistor, including a capacitive element connecting the bulk of the MOS transistor to a source of an voltage.

24 Claims, 2 Drawing Sheets

METHOD AND DEVICE FOR ADAPTING THE VOLTAGE OF A MOS TRANSISTOR BULK

BACKGROUND OF THE INVENTION

1. Field of the Invention

The present invention relates to a device and a method for biasing the bulk of a metal-oxide semiconductor field-effect transistor, or MOS transistor.

2. Discussion of the Related Art

Theoretically, when the voltage between the gate and the source of an N-channel MOS transistor is greater than a threshold voltage, a current capable of flowing between the drain and the source of the transistor according to the applied drain-source voltage. The transistor is then on or said to be in the active state. When the gate-source voltage is lower than the threshold voltage, the transistor is off or said to be in the inactive state and is equivalent to an open switch. However, in practice, the flowing of a current, called the leakage current, can be observed in the inactive state between the drain and the source of the MOS transistor.

For certain applications, electronic circuits having the lowest possible power consumption are desired to be obtained. These, for example, are cell phones, portable consoles, etc., which are supplied by batteries. It is then necessary to reduce the leakage currents of the transistors of such electronic circuits to decrease the power consumption of the electronic circuit in the off state.

Several factors have an influence upon the amplitude of the leakage current of a transistor in the off state. In particular, for an N-channel MOS transistor, the leakage current increases as the transistor threshold voltage decreases, as the voltage between the bulk and the source of the transistor increases, or as the voltage between the gate and the source of the transistor is high.

A conventional method for decreasing the leakage current of an N-channel MOS transistor having its source connected to ground comprises biasing the bulk of the N-channel MOS transistor to a voltage lower than the source voltage. For a P-channel MOS transistor having its source receiving a supply voltage, such a method comprises biasing the transistor bulk to a voltage greater than the source voltage. Such a method is called a reverse bulk biasing.

A disadvantage of such a method is that the transistor bulk biasing is generally performed by a voltage source connected, in the inactive state, to the transistor bulk. The forming of such a voltage source can be relatively complex. Further, the operation of such a voltage source translates as an additional consumption which limits the in the total consumption due to the transistor leakage current decrease.

SUMMARY OF THE INVENTION

The present invention aims at overcoming all or part of the disadvantages of known devices and methods for biasing the bulk of a MOS transistor.

An embodiment of the present invention provides a device for biasing the bulk of a MOS transistor which has a decreased power consumption.

Embodiments of the present invention also more specifically aim at a method for biasing the bulk of a MOS transistor, the implementation of which brings about reduced additional consumption.

An embodiment of the present invention provides a circuit for biasing the bulk of a MOS transistor, the bulk of the MOS transistor being surrounded by a well providing electric insulation of the substrate. The circuit comprises a capacitive element connecting the bulk of the MOS transistor to a source of an A.C. voltage at a first value for a first time period and at a second value for a second time period shorter than half of the first time period.

According to an embodiment of the present invention, the capacitive element comprises an electrode directly connected to the substrate.

According to an embodiment of the present invention, the source is capable of providing the A.C. voltage at the first value for the first time period and at the second value for the second time period shorter than 1/10 of the first time period.

According to an embodiment of the present invention, the MOS transistor is an N-channel transistor, the second value being the zero voltage, and the first value being greater than the forward voltage drop of the bulk-source junction of the MOS transistor.

According to an embodiment of the present invention, the circuit comprises means capable of connecting the bulk and the gate of the MOS transistor when the MOS transistor is in the inactive state.

According to an embodiment of the present invention, the circuit comprises an additional MOS transistor having its main terminals connecting the bulk to the gate of the MOS transistor and means capable of connecting the gate of the additional transistor to the gate of the MOS transistor when the MOS transistor is in the inactive state.

According to an embodiment of the present invention, the means are capable of connecting the gate of the additional MOS transistor to the bulk of the MOS transistor when the MOS transistor is in the active state.

According to an embodiment of the present invention, the MOS transistor is formed at the level of an SOI-type, GeOI-type or SON-type support.

According to an embodiment of the present invention, the MOS transistor comprises a first main terminal connected to a terminal of an electronic circuit and a second main terminal connected to a source of a reference voltage, the assembly formed by the MOS transistor, the capacitive element, and the source of the A.C. voltage forming a pump of the charges of the MOS transistor bulk, the MOS transistor further behaving as a switch for the electronic circuit.

An embodiment of the present invention also provides a method for biasing the bulk of a MOS transistor, the bulk of the MOS transistor being surrounded by a well providing electric insulation of the substrate. The method comprises the connection of the MOS transistor bulk to a source of an A.C. voltage by a capacitive element, the A.C. voltage being at a first value for a first time period and at a second value for a second time period shorter than half of the first time period.

According to an embodiment of the present invention, the second time period is shorter than 1/10 of the first time period.

According to an embodiment of the present invention, the method further comprises the provision of an additional MOS transistor having its main terminals connecting the bulk to the gate of the MOS transistor and the connection of the gate of the additional transistor to the gate of the MOS transistor when the MOS transistor is in the inactive state and the connection of the gate of the additional MOS transistor to the bulk of the MOS transistor when the MOS transistor is in the active state.

The foregoing and other objects, features, and advantages of embodiments of the present invention will be discussed in detail in the following non-limiting description of specific embodiments in connection with the accompanying drawings.

DETAILED DESCRIPTION

Figure 1:
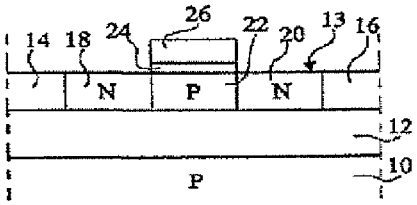
FIG. 1 is a simplified cross-section view of an N-channel MOS transistor formed at the level of an SOI-type bulk.

For clarity, the same elements have been designated with the same reference numerals in the different drawings and, further, as is usual in the representation of integrated circuits, the various drawings are not drawn to scale. In the following description, the node voltages of an electronic circuit are measured with respect to the electronic circuit ground, the ground voltage being taken as equal to 0 V.

The present invention provides for modifying the voltage of the bulk of a MOS transistor in the inactive state to decrease the transistor leakage current, the bulk voltage modification being obtained by a method which only causes a very low additional consumption. Embodiments of the present invention apply to a transistor for which the bulk voltage is capable of being modified. Embodiments of the present invention can thus apply to an insulated-bulk MOS transistor, for example, a MOS transistor formed at the level of a bulk of silicon-on-insulator or SOI type, of a bulk of germanium-on-insulator or GeOI type, or of a bulk of silicon-on-nothing or SON type. The bulk of the transistor is at least partially surrounded by a well of an insulated material which provides an electrical insulation of the bulk. Embodiments of the present invention also apply to a MOS transistor formed at the level of a silicon wafer for which the transistor bulk is electrically insulated from the rest of the wafer, for example, via a well having an adapted dopant type surrounding the transistor. In this last case, the well biasing is capable of insulating the transistor bulk, that is, the well is reverse-biased with respect to the other adjacent junctions to insulate electrically the transistor bulk.

With respect to the technology for which the bulks of the MOS transistors are not floating, the advantage of the partially deserted SOI type technology, in terms of performance, is linked to the dynamic modulation of the threshold voltage of the transistors. This dynamic modulation is due to the variation of the potential of the floating bulk of the transistors. The drawback of a common method for the reduction of the leakage currents of a MOS transistor is that the bulk is not left floating any more. In the active state, the advantage of the dynamic modulation of the threshold voltage of the transistor is lost. The interest of the invention is to be able to command the polarization of the bulk in the inactive state while letting the possibility to let the bulk floating in the active state. To do so, the potential of the floating bulk of the transistor is commanded by the modulation of its charge.

FIG. 1 very schematically shows a cross-section of an N-channel MOS transistor formed at the level of an SOI-type bulk. A support 10, for example a P-type doped silicon wafer, is covered with an insulating layer 12, for example, silicon oxide. Active single-crystal silicon areas 13 separated by insulating regions 14, 16 are formed on insulating layer 12. The MOS transistor is formed at the level of one of active areas 13 and comprises two N-type doped regions 18, 20 separated by a P-type doped region 22. Regions 18, 20 correspond to the drain and to the source of the MOS transistor and region 22 corresponds to the MOS transistor bulk. Region 22 is covered with an insulating layer 24, corresponding to the gate oxide, itself covered with a conductive region 26, corresponding to the transistor gate. Such a transistor is said to be formed according to a partially depleted SOI or SOI-PD technology, since bulk 22 of the transistor is left floating.

Embodiments of the present invention will now be described in the context of a specific application for the reduction of the leakage current of a MOS power transistor used as an electronic circuit switch. A MOS power transistor is a MOS transistor capable of conducting high currents in the active state and having a low leakage current in the inactive state as compared to the leakage currents of so-called fast-switching MOS transistors conventionally used in electronic circuits. A MOS power transistor may conventionally be used as a switch to decrease the consumption of an electronic circuit in the inactive state. For this purpose, the MOS transistor is generally available between the electronic circuit and the ground. The MOS power transistor is off when the electronic circuit is in the inactive state (or at stand-by) to limit the total electric losses. The bulk of the MOS power transistor is biased to decrease the leakage current of the transistor used as a switch and thus further decreasing the electronic circuit consumption in the inactive state. However, it should be clear that the present invention generally applies to any type of MOS transistor having a leakage current in the inactive sate which is desired to be decreased.

Figure 2:
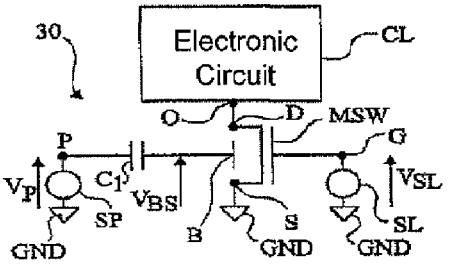
FIG. 2 illustrates a device for biasing the bulk of a MOS transistor according to an embodiment of the present invention.

FIG. 2 shows an embodiment of a circuit 30 for biasing the bulk of an N-channel MOS power transistor MSW arranged between an output terminal O of an electronic circuit CL and a source of a reference voltage GND, for example, the ground. Electronic circuit CL comprises, for example, MOS transistors with a low threshold voltage which have switching speeds greater than that of MOS power transistor MSW. Transistor MSW comprises a source S, a drain D, a bulk B, and a gate G. Transistor MSW is, for example, formed at the level of an SOI-type bulk and has the structure shown in FIG. 1. Source S is connected to ground GND and drain D is connected to output terminal O. Gate G is connected to a terminal of a voltage source SL having its other terminal connected to ground GND. The voltage across voltage source SL is called $V_{SL}$.

In the above embodiment, circuit 30 comprises a capacitor $C_1$ having an electrode directly connected to bulk B and having its other electrode connected to a terminal of a voltage source SP. The other terminal of voltage source SP is connected to ground GND. The voltage across voltage source SP is called $V_P$. According to an example, capacitor $C_1$ comprises two metallic electrodes separated by a dielectric material. In this case, as compared with the structure shown in FIG. 1, region 22 comprises an extension, not shown, enabling forming of a contact pad to connect the transistor bulk to an electrode of capacitor $C_1$. According to another example, capacitor $C_1$ comprises two electrodes of polysilicon, or a first metallic electrode and a second polysilicon electrode. As compared with the structure shown in FIG. 1, region 22 can comprise an extension, not shown, directly in contact with the second electrode. According to another example, capacitor $C_1$ can comprise a metallic or polysilicon electrode and an electrode corresponding to a doped silicon region which is, by example, in contact with bulk B. Voltage sources SP and SL may correspond to any type of electronic circuit capable of providing the desired voltages $V_P$ and $V_{SL}$. In particular, voltages $V_P$ and $V_{SL}$ may be obtained from a single voltage source.

In the inactive state, voltage $V_P$ corresponds to a periodic rectangular voltage varying, for example, between the zero voltage and supply voltage VDD. The period of voltage $V_P$ for example is on the order of 100 ms. Duty cycle $\alpha$ of voltage $V_P$ corresponds to the ratio between the time period during which voltage $V_P$ is equal to VDD and the time period during which voltage $V_P$ is equal to 0 V. According to the first embodiment, duty cycle $\alpha$ is lower than 1, for example, lower than ½, preferably, lower than 1/10, more preferably lower than 1/100, for example, on the order of 1/500 for a circuit formed by an SOI technology. For example, for the technology node 130 nm SOI-PD, the duty cycle a can be inferior to 1/500.

Figure 3:
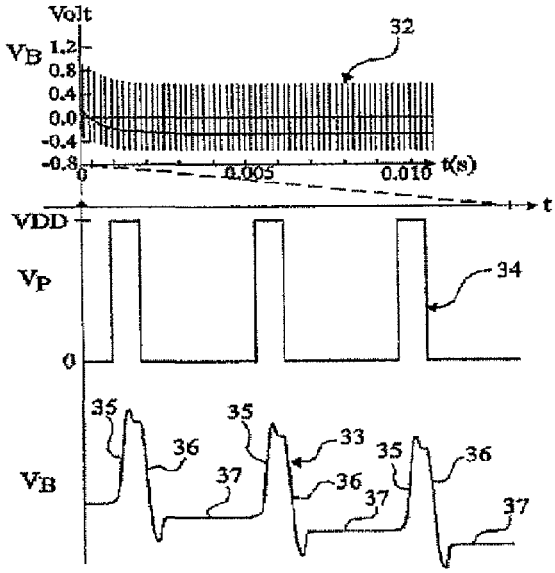
FIG. 3 shows curves of variation of voltages on implementation of the biasing method according to an embodiment of the present invention.

FIG. 3 shows a curve 32 of variation of the voltage of bulk B, called $V_B$, of transistor MSW in the inactive state, a variation curve 33 which corresponds to an enlargement of variation curve 32 of voltage $V_B$ for the first periods of signal $V_P$ on setting to the inactive state of transistor MSW, and a variation curve 34 of signal $V_P$. Curve 32 is drawn to scale. However, curves 33 and 34 are not drawn to scale.

In this embodiment, circuit 30 enables, in the inactive state, globally decreasing voltage $V_B$ of bulk B of transistor MSW to a negative voltage to decrease the leakage current of transistor MSW. This embodiment uses the fact that for a MOS transistor having its bulk B not directly connected to a source of a constant voltage, voltage $V_B$ depends on charge quantity $Q_B$ stored at the level of bulk B.

For circuit 30 shown in FIG. 2, voltage $V_B$ is obtained, at a given time, based on the following relation:

$$V_B=(Q_B+C_DV_D+C_SV_S+C_GV_G+C_1V_P)/C_T \quad (1)$$

where $V_D$, $V_S$, and $V_G$ respectively corresponds to the voltage of drain D, of source S, and of gate G, where $C_D$, $C_S$, and $C_G$ respectively correspond to the drain, source, and gate capacitance and where $C_T$ corresponds to the sum of capacitances $C_G$, $C_S$, $C_D$, and $C_1$.

Charge quantity $Q_B$ varies according to the charge rate and to the discharge rate of bulk B at a given time. The charge rate of bulk B is representative of phenomena causing the generation of carriers (for example, the forming of a tunnel current, impact ionization phenomena, etc.), that is, causing an increase of $Q_B$. The discharge rate of bulk B is representative of phenomena causing the recombination of carriers (for example, the forming of a drain-bulk or source-bulk junction current), that is, causing a decrease of $Q_B$. Generally, phenomena causing the recombination of carriers are much faster than phenomena causing the generation of carriers, by a factor that may vary from 100 to 1,000.

At the static equilibrium, charge quantity $Q_B$ is substantially constant and set by voltages $V_B$, $V_D$, $V_S$, $V_G$, and voltage $V_P$. When the values of voltages $V_D$, $V_S$, $V_G$ are modified, charge $Q_B$ varies, for a longer or shorter transition phase, towards a new static equilibrium. During this transition phase, transistor MSW is at an intermediary state between two states of equilibrium.

An embodiment of the present invention comprises controlling charge quantity $Q_B$ by varying voltage $V_P$. More specifically, this embodiment of the present invention uses the fact that the time period necessary for the bulk charge is much longer than the time period necessary for the bulk discharge, so that it is enough, to control charge quantity $Q_B$, to periodically set voltage $V_P$ to VDD for a very short time period. Most of the time, voltage $V_P$ is left at 0 V, charge quantity $Q_B$ then varying little and setting voltage $V_B$ to a substantially constant negative value. Thereby, except at the level of the pulses of voltage $V_P$, voltage $V_B$ is practically always constant and negative.

As an example, it is initially assumed that voltages $V_D$, $V_S$ and $V_G$ are at zero, that voltage $V_P$ is at zero, and that transistor MSW has reached a state of equilibrium corresponding to an initial charge quantity $Q_{B0}$. When voltage $V_P$ switches to VDD, voltage $V_B$ increases due to the capacitive coupling due to capacitor $C_1$ (ascending portion 35 of curve 33). However, the increase of $V_B$ with respect to $V_S$, which is zero, tends to turn on the junction between bulk B and source S of transistor MSW. Negative charges are then injected into bulk B, which causes a decrease in charge quantity $Q_B$ from $Q_{B0}$ to $Q_{B1}$ due to carrier recombination phenomena.

When voltage $V_P$ switches from VDD to 0 V, voltage $V_B$ decreases due to the capacitive coupling due to capacitor $C_1$ (descending portion 36 of curve 33). The bulk-source junction of transistor MSW is thus no longer conductive, whereby carrier recombination phenomena tend to stop. Charge $Q_B$ should increase slowly from $Q_{B1}$ to $Q_{B0}$ due to carrier generation phenomena. However, such phenomena being slow as compared with the switching frequency of $V_P$, everything occurs as if the charge quantity had remained constant and equal to $Q_{B1}$ Voltage $V_B$ thus settles at the value corresponding to $Q_{B1}$ given by relation (1) and varies little before the next switching of $V_P$ from 0 V to VDD (constant portion 37 of curve 33). Since $Q_{B1}$ is lower than $Q_{B0}$, voltage $V_B$ has decreased. This phenomenon repeats for the first cycles of voltage $V_P$ so that voltage $V_B$ decreases at the level of constant portions 37.

After several successive cycles of voltage $V_P$, voltage $V_B$ has sufficiently decreased so that when voltage $V_P$ switches from 0 V to VDD, voltage $V_B$ is not high enough to make the bulk-source junction completely conductive, but only slightly conductive to compensate for the charge generation. Charge quantity $Q_B$ then substantially no longer varies and voltage $V_B$ remains, when $V_P$ is at 0 V, at a negative value, for example, between −0.5 V and −1 V.

The assembly formed of voltage source SP, capacitor $C_1$, and transistor MSW thus behaves as a charge pump capable of decreasing charge quantity $Q_B$.

Generally, the values between which $V_P$ varies may be different from 0 V and VDD. The only condition is that the variation of $V_P$ causes by capacitive effect a variation of voltage $V_B$ sufficient to turn on the bulk-source junction of transistor MSW, at least at the beginning of the switching to the inactive state.

Figure 4:
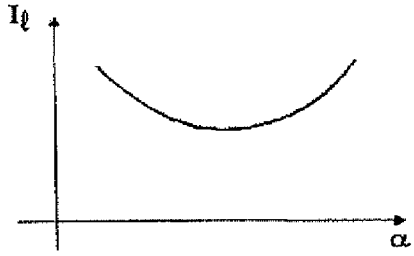
FIG. 4 shows the variation of the leakage current of the circuit of FIG. 2 according to the duty cycle of a circuit voltage.

FIG. 4 shows the variation of leakage current $I_1$ of circuit 30 according to duty cycle $\alpha$. To determine the duty cycle $\alpha$ which enables obtaining the lowest possible leakage current, it may be proceeded by successive trials. For this purpose, it is possible to assign several duty cycle values to voltage $V_P$, to determine the corresponding leakage currents, and to select the duty cycle which provides the minimum leakage current. The simulation software used in computer-aided design such as the SPICE-type simulator (Simulation Program with Integrated Circuit Emphasis), for example, simulators ELDO or HSIM.

The period of signal $V_P$ is determined for the dynamic consumption of circuit 30 to be as low as possible. Part of the dynamic consumption is due to the switching of voltage $V_P$ on a rising or falling edge. To decrease the dynamic consumption, the period of signal $V_P$ is selected to be as large as possible to limit the number of switchings of voltage $V_P$.

Figure 5:
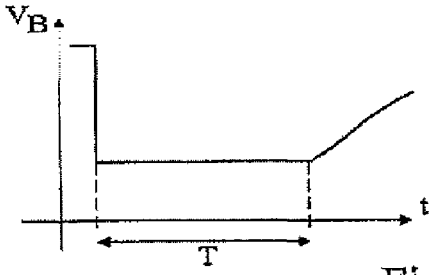
FIG. 5 illustrates the principle of determination of the period of a voltage used by the circuit of FIG. 2.

FIG. 5 shows the variation of voltage $V_B$ along time when a falling edge is applied on $V_P$ (switching from a high value to a low value). The abscissa scale is a logarithmic scale. By capacitive coupling, when voltage $V_P$ decreases, a decrease in voltage $V_B$, which settles at a low value, can be observed. Time period T for which $V_B$ remains substantially constant at the low value before increasing is then determined. The period of signal $V_P$ may correspond to the time period T thus determined. The frequency of signal $V_P$ is called F.

When circuit 30 switches from the active state to the inactive state (or to stand-by), the frequency of signal $V_P$ may be accelerated in an initial phase with respect to previously-determined frequency F, to decrease voltage $V_B$ of transistor MSW as fast as possible. Then, the frequency of signal $V_P$ is set back to frequency F to maintain voltage $V_B$ at the low value while decreasing the dynamic consumption of circuit 30.

Figure 6:
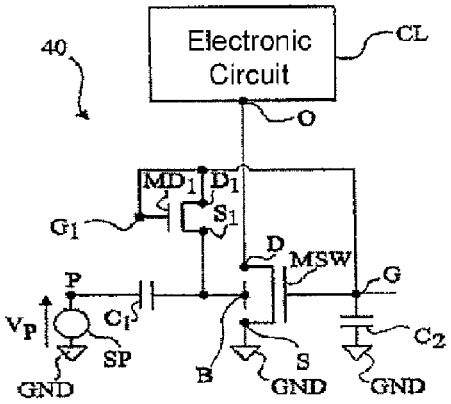
FIG. 6 shows a biasing device according to another embodiment of the present invention.

FIG. 6 shows a biasing circuit 40 according to an embodiment of the present invention. Circuit 40 corresponds to circuit 30 shown in FIG. 2 in which a diode-assembled N-channel MOS transistor $MD_1$ has been added, having its gate $G_1$ and its drain $D_1$ connected to gate G of transistor MSW. Source $S_1$ of transistor $MD_1$ is connected to bulk B of transistor MSW. A capacitor $C_2$ is provided between gate G and ground GND. Alternatively, capacitor $C_2$ is not present. In the inactive state, voltage source SL is at high impedance and is not shown in FIG. 6. Circuit 40 enables setting bulk B to a negative voltage in the inactive state and, in parallel, setting gate G of transistor MSW to a negative voltage. Indeed, the leakage current of an N-channel MOS transistor is all the greater as the voltage between the gate and the source is high. The leakage current of transistor MSW in the active state is thus further decreased.

Figure 7:
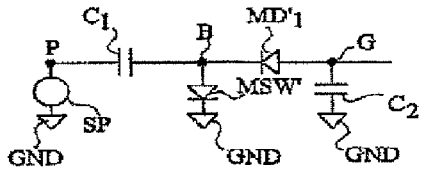
FIG. 7 is a diagram of an electric circuit equivalent to the device shown in FIG. 6.

FIG. 7 shows an electric diagram equivalent to circuit 40 shown in FIG. 6 in the inactive state. Transistor MSW is equivalent to a diode MSW' having its anode connected to bulk B and having its cathode connected to ground GND. Transistor $MD_1$ is equivalent to a diode $MD_{1'}$ having its anode connected to gate G and having its cathode connected to bulk B. According to such an assembly, voltage $V_G$ follows, in average, voltage $V_B$. Capacitor $C_2$, if present, enables settling voltage $V_G$. FIG. 7 also corresponds to a charge pump diagram. This means that transistor MSW has two functions: the first one is that of a power switch and the second one is that of an active element of the charge pump.

Alternatively, transistor $MD_1$ may be replaced with a diode having its anode connected to gate G and having its cathode connected to bulk B.

Figure 8:
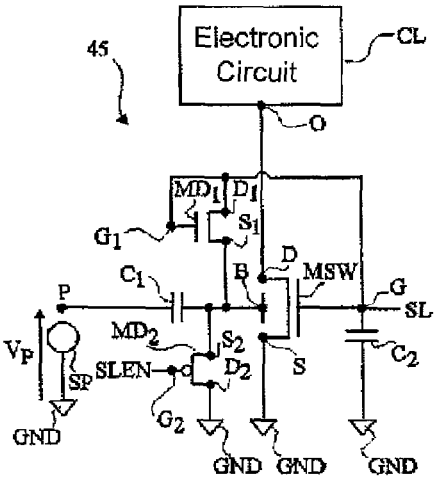
FIG. 8 shows a biasing device according to another embodiment of the present invention.

FIG. 8 shows a bias circuit 45 according to another embodiment of the present invention in which, with respect to circuit 40 shown in FIG. 6, a P-channel MOS transistor $MD_2$ having its gate $G_2$ controlled by a signal SLEN, having its drain $D_2$ connected to ground GND, and having its source $S_2$ connected to bulk B, has been added between bulk B and ground GND. When transistor $MD_2$ is on, which corresponds to signal SLEN set to 0 V, transistor $MD_2$ behaves as a diode having its anode connected to bulk B and having its cathode connected to ground GND. This additional diode is thus in parallel with the bulk-source junction of transistor MSW, which tends to turn on when voltage $V_P$ switches to VDD. Such an additional diode enables, when voltage $V_P$ switches to VDD, ensuring for voltage $V_B$ not to rise above 0.5-0.6 V and enhancing the evacuation of the charges from bulk B.

The applicant has determined, by simulation, the consumption gain in the case where electronic circuit CL corresponds to a ring oscillator comprising 141 stages and formed of fast-switching MOS transistors (that is, having a low threshold voltage, for example, on the order of 240 mV) formed in SOI-PD technology with a 130-nanometer gate width, and for a 1.2-V supply voltage. The used power transistor MSW is of the type enabling a delay penalty lower than 2%. Transistors $MD_1$, $MD_2$ of circuit 45 are transistors of low-leakage type (high threshold voltage on the order of 350 mV). The consumption reduction ratio, R, is defined by the following relation:

$$R=I_{cir}/I_{sw} \quad (2)$$

where $I_{cir}$ corresponds to the leakage current at output terminal O of electronic circuit CL when it is directly connected to ground GND, and $I_{sw}$ corresponds to the leakage current measured at output terminal O when electronic circuit CL is connected to ground GND via power transistor MSW.

Figure 9:
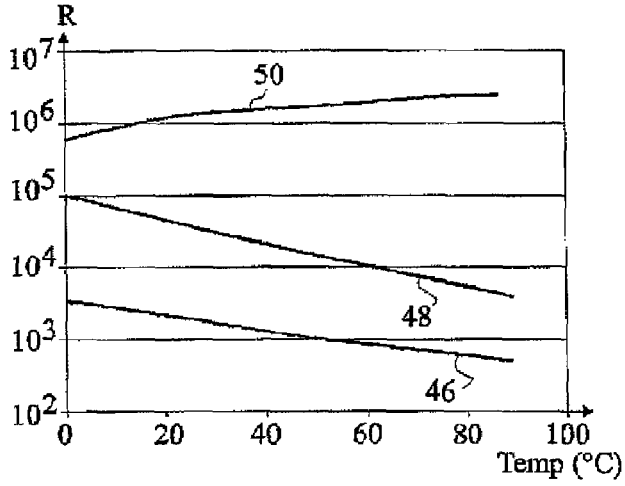
FIG. 9 shows three curves of variation of the consumption gain for three leakage current reduction methods.

FIG. 9 shows the variation of the ratio according to temperature. Curve 46 corresponds to the variation of the ratio obtained when the bulk of transistor MSW is left floating. Curve 48 corresponds to the ratio variation obtained when bulk B of transistor MSW is permanently connected to ground GND. Curve 50 corresponds to the ratio variation obtained when biasing circuit 45 is associated with transistor MSW.

It is noted that biasing circuit 45 provides a significant increase in the consumption gain with respect to what used to be conventionally obtained. Further, for curves 46 and 48, the consumption gain tends to decrease as the temperature increases. Conversely, for the present invention, the consumption gain increases along with temperature.

Figure 10:
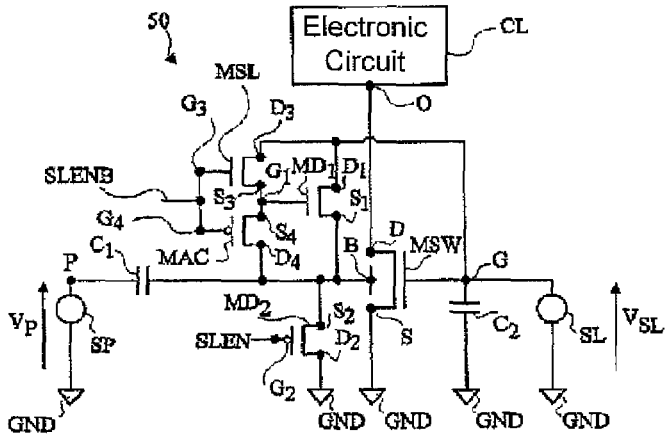
FIGS. 10 and 11 respectively show examples of the biasing device according to another embodiment of the present invention.

FIG. 10 shows a biasing circuit 50 according to another embodiment of the present invention in which, with respect to circuit 45 of FIG. 8, an N-channel MOS transistor MSL having its drain $D_3$ connected to drain $D_1$ of transistor $MD_1$ and having its source $S_3$ connected to gate $G_1$ of transistor $MD_1$ has been added. Circuit 50 also comprises a P-channel MOS transistor MAC having its drain $D_4$ connected to bulk B of transistor MSW and having its source $S_4$ connected to gate $G_1$ of transistor $MD_1$. Gates $G_3$, $G_4$ of transistors MSL and MAC receive signal SLENB which is the complementary of signal SLEN.

When electronic circuit CL is in the inactive state, signal SLEN is in the low state, for example, at 0 V, and signal SLENB is in the high state, for example, VDD. In this case, transistor MAC is off and transistor MSL is on. Further, transistor $MD_2$ is on and diode-assembled. Circuit 50 is then identical to circuit 45. Its operation thus corresponds to what has been previously described. When electronic circuit CL is in the active state, signal SLEN is in the high state and signal SLENB is in the low state. Transistors $MD_2$ and MSL are then off. Transistor MAC is on and is substantially equivalent to an on switch. Gate $G_1$ of transistor $MD_1$ is thus connected to bulk B of transistor MSW. Transistor $MD_1$ then operates as a current limiter and is equivalent to a diode having its anode connected to bulk B and its cathode connected to gate G.

In the active state, voltages $V_P$ and $V_{SL}$ are at VDD. Transistor $MD_1$ enables bringing $V_B$ to a value greater than 0 V while ensuring for voltage $V_B$ to remain lower than 0.6 V so that there is no forward biasing of the bulk-source junction of transistor MSW. The fact of setting voltage $V_P$ to VDD enables initially raising voltage $V_B$ by capacitive coupling, voltage $V_B$ being maintained afterwards at a positive value by a transistor $MD_1$.

A transistor MSW having a bulk positively biased in the active state is thus obtained. This enables decreasing the transistor threshold voltage and improving the conduction of transistor MSW in the active state. For the same current to be conducted, the dimensions of transistor MSW can then be decreased with respect to a MOS transistor having a bulk which would be maintained grounded in the active state. The use of a transistor MSW of decreased dimensions enables decreasing the leakage currents in the inactive state. Circuit 50 enables decreasing by approximately 15% the surface area taken up by transistor MSW. More generally, circuit 50 enables obtaining a transistor MSW with two dynamically-modulated threshold voltages, a first low threshold voltage in the active state (bulk B being positively biased) ensuring a better conduction and a second high threshold voltage in the inactive state (the bulk being negatively biased) enabling decreasing the leakage current.

Figure 11:
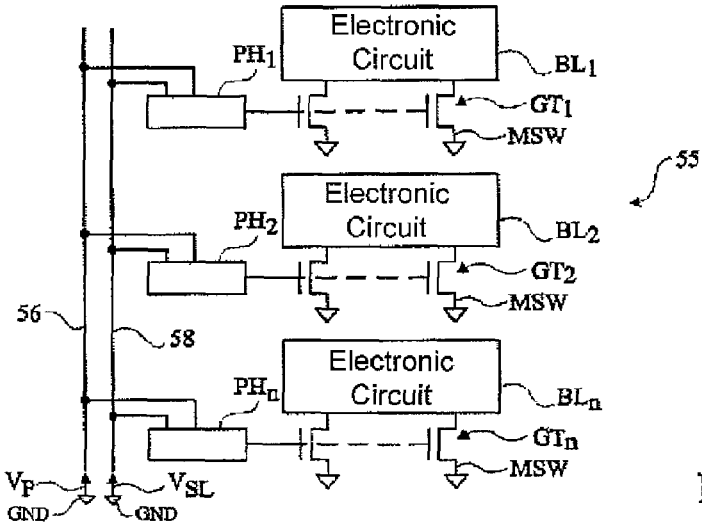

FIG. 11 shows a bias circuit 55 according to an embodiment of the present invention, used to decrease the leakage currents of several power transistors MSW. Power transistors MSW are distributed into groups of power transistors $GT_i$, i being an integer ranging between 1 and n, each group $GT_i$ being associated with an electronic circuit $BL_i$ formed, for example, of fast-switching transistors. The gates of the transistors MSW of each group of transistors $GT_i$ are connected to a partial biasing circuit $PH_i$. Each circuit $PH_i$ comprises MOS transistors $MD_1$, $MD_2$, MSL, MAC, and capacitors $C_1$, $C_2$ of circuit 50. Each partial circuit $PH_i$ is connected to a first line 56 connected to voltage source SP, not shown, and to a second line 58 connected to voltage source SL, not shown. Single voltage sources SP and SL are thus connected to each circuit $PH_i$. Same elements of the bias circuits being associated with several transistors, the increase in the surface area due to the use of a bias circuit according to an embodiment of the present invention is thus decreased.

Advantageously, to avoid degradation of transistor MSW, for example, by breakdown of the oxide layer due to a voltage difference between the drain and the gate of transistor MSW greater than the supply voltage, a transistor MSW with a thick gate oxide, capable of operating with high supply voltages, may be used. Such a transistor with a thick gate oxide is, for example, of type GO2, the gate oxide thickness being approximately 2.7 nm, the other circuit transistors having an oxide thickness on the order of 1.5 nm.

Of course, the present invention is likely to have various alterations, improvements, and modifications which will readily occur to those skilled in the art. In particular, voltage source SP may provide a signal other than rectangular. It may be a constant signal at 0 V periodically comprising triangular pulses. Further, the present invention has been described for the biasing of the bulk of an N-channel MOS transistor. However, the present invention may apply to the biasing of the bulk of a P-channel MOS transistor having its source connected to a source of a high reference voltage, for example, VDD. In this case, the transistor bulk is set, in the inactive state, to a voltage greater than the source voltage by varying $V_P$ between 0 V (short pulses) and VDD. Further, the gate voltage may be brought to a voltage greater than the source voltage in the inactive state. Further, the bulk voltage may be brought to a voltage lower than the source voltage in the active state.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A circuit for biasing the bulk of a MOS transistor, wherein the bulk of the MOS transistor is surrounded by a well providing an electric insulation of the bulk, the circuit comprising a capacitive element connecting the bulk of the MOS transistor to a source adapted to provide a periodic A.C. voltage which alternates between a first value for a first time period and a second value for a second time period shorter than half of the first time period, wherein the MOS transistor, the capacitive element and the source of the A.C. voltage form a charge pump for adjusting a charge quantity of the MOS transistor bulk.

2. The circuit of claim 1, wherein the capacitive element comprises an electrode directly connected to the bulk.

3. The circuit of claim 1, wherein the source is capable of providing the voltage at the first value for the first time period and at the second value for the second time period shorter than 1/10 of the first time period.

4. The circuit of claim 1, wherein the MOS transistor is an N-channel transistor, the second value being the zero voltage, and the first value being greater than a forward voltage drop of the bulk-source junction of the MOS transistor.

5. The circuit of claim 1, comprising means capable of connecting the bulk and the gate of the MOS transistor when the MOS transistor has a gate-to-source voltage less than a threshold voltage of the MOS transistor.

6. The circuit of claim 1, comprising an additional MOS transistor having its main terminals connecting the bulk to the gate of the MOS transistor and means capable of connecting the gate of the additional transistor to the gate of the MOS transistor when the MOS transistor has a gate-to-source voltage less than a threshold voltage of the MOS transistor.

7. The circuit of claim 6, wherein the means are capable of connecting the gate of the additional MOS transistor to the bulk of the MOS transistor when the MOS transistor has a gate-to-source voltage greater than a threshold voltage of the MOS transistor.

8. The circuit of claim 1, wherein the MOS transistor is formed on a silicon-on-insulate-type substrate.

9. The circuit of claim 1, wherein the MOS transistor comprises a first main terminal connected to a terminal of an electronic circuit and a second main terminal connected to a source of a reference voltage.

10. A method for biasing a bulk of a MOS transistor, characterized in that the bulk of the MOS transistor is surrounded by a well providing an electric insulation of the bulk, the method comprising:

connecting a capacitive element to the MOS transistor bulk and to an A.C. voltage source; and supplying a periodic voltage to the MOS transistor bulk and the capacitive element, the periodic voltage being delivered by the A.C. voltage source, and the A.C. voltage source alternating between a first value for a first time period and a second value for a second time period shorter than half of the first time period, wherein the MOS transistor, the capacitive element and the A.C. voltage source form a charge pump for adjusting a charge quantity of the MOS transistor bulk.

11. The method of claim 10, wherein the capacitive element comprises an electrode directly connected to the bulk.

12. The method of claim 10, wherein the second time period is shorter than 1/10 of the first time period.

13. The method of claim 10, further comprising the provision of an additional MOS transistor having its main terminals connecting the bulk to the gate of the MOS transistor and the connection of the gate of the additional transistor to the gate of the MOS transistor when the MOS transistor is in the inactive state and the connection of the gate of the additional MOS transistor to the bulk of the MOS transistor when the MOS transistor is in the active state.

14. A circuit, comprising:

a MOS transistor having an isolated bulk; and a capacitive element coupled to the isolated bulk and to a power source, the power source configured to supply the capacitive element a first voltage for a first time period and a second voltage for a second time period shorter than half of the first time period, wherein the MOS transistor, the capacitive element and the power source form a charge pump for adjusting a charge quantity of the MOS transistor bulk.

15. The circuit of claim 14, wherein the second time period is shorter than 1/10 of the first time period.

16. The circuit of claim 14, further comprising a second transistor coupled to the capacitive element, the isolated bulk and a gate of the MOS transistor.

17. The circuit of claim 16, wherein the second transistor is a diode-connected transistor.

18. The circuit of claim 16, wherein a second capacitive element is coupled to a gate of the second transistor and the gate of the MOS transistor.

19. The circuit of claim 14, further comprising a third transistor coupled to the capacitive element, the isolated bulk and a second voltage supply.

20. The circuit of claim 19, wherein the second voltage supply is a ground terminal.

21. A method for biasing an isolated bulk of a MOS transistor, the method comprising supplying a periodic voltage to the isolated bulk, the periodic voltage having a first value for a first time period and a second value for a second time period shorter than half of the first time period, wherein the periodic voltage is supplied to a capacitive element coupled to the isolated bulk, and wherein the MOS transistor, the capacitive element and the supplied periodic voltage form a charge pump for adjusting a charge quantity of the MOS transistor bulk.

22. The method of claim 21, further comprising connecting a diode-connected transistor to the capacitive element and the isolated bulk.

23. The method of claim 21, further comprising connecting a diode-connected transistor to a gate of the MOS transistor.

24. The method of claim 21, wherein the bulk is isolated by surrounding the bulk by a well.

* * * * *

UNITED STATES PATENT AND TRADEMARK OFFICE

CERTIFICATE OF CORRECTION

PATENT NO. : 7,622,983 B2
APPLICATION NO. : 11/687047
DATED : November 24, 2009
INVENTOR(S) : Olivier Thomas et al.

It is certified that error appears in the above-identified patent and that said Letters Patent is hereby corrected as shown below:

Title Page

The last line of the Abstract should read:
to a source of an AC voltage.

Signed and Sealed this

Fifth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,622,983 B2
APPLICATION NO. : 11/687047
DATED : November 24, 2009
INVENTOR(S) : Olivier Thomas et al.

It is certified that error appears in the above-identified patent and that said Letters Patent is hereby corrected as shown below:

Title Page Item (74) should read:
*Attorney, Agent, or Firm* - Lisa K. Jorgenson, James H. Morris; Wolf, Greenfield & Sacks, P.C.

Signed and Sealed this

Sixteenth Day of March, 2010

David J. Kappos

David J. Kappos
*Director of the United States Patent and Trademark Office*